US010750580B2

(12) United States Patent
An et al.

(10) Patent No.: US 10,750,580 B2
(45) Date of Patent: Aug. 18, 2020

(54) COOKING APPLIANCE

(71) Applicants: GUANGDONG MIDEA KITCHEN APPLIANCES MANUFACTURING CO., LTD., Foshan (CN); MIDEA GROUP CO., LTD., Foshan (CN)

(72) Inventors: Mingbo An, Foshan (CN); Ming Zhang, Foshan (CN)

(73) Assignees: GUANGDONG MIDEA KITCHEN APPLIANCES MANUFACTURING CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 342 days.

(21) Appl. No.: 15/859,623

(22) Filed: Dec. 31, 2017

(65) Prior Publication Data

US 2018/0343710 A1 Nov. 29, 2018

(30) Foreign Application Priority Data

May 26, 2017 (CN) ..... 2017 1 0386415

(51) Int. Cl.
*H05B 6/64* (2006.01)

(52) U.S. Cl.
CPC ..... *H05B 6/6408* (2013.01)

(58) Field of Classification Search
CPC ..... H05B 6/6408; H05B 6/64
See application file for complete search history.

(56) References Cited

U.S. PATENT DOCUMENTS 5,250,773 A * 10/1993 Lind ..... H05B 6/80 219/690
5,717,192 A * 2/1998 Dobie ..... A21B 1/245 219/681
5,801,363 A * 9/1998 Michaluk ..... F24C 15/16 126/220

(Continued)

FOREIGN PATENT DOCUMENTS

CN 201223125 Y * 4/2009
CN 201806578 U 4/2011

(Continued)

OTHER PUBLICATIONS

First Patent Search of Application No. CN201710386415.0, dated May 26, 2017. 2 pgs.

(Continued)

*Primary Examiner* — Frederick C Nicolas
(74) *Attorney, Agent, or Firm* — Morgan, Lewis & Bockius LLP

(57) ABSTRACT

The present disclosure provides a cooking appliance that includes a cooking cavity body, in which a cooking cavity is formed; a heating plate, movably mounted in the cooking cavity; and an adjusting device, mounted to the heating plate and used for driving the heating plate to continuously reciprocate in the cooking cavity. According to the technical solution, the heating plate can continuously reciprocate up and down or left and right in the cooking cavity under the action of the adjusting device, and when the cooking appliance is specifically used for heating food, the height of the heating plate can be adjusted according to the category and height of the food to adjust the distance between the heating plate and the bottom wall of the cooking cavity.

16 Claims, 5 Drawing Sheets

(56) References Cited

U.S. PATENT DOCUMENTS

| | | | | |
|---|---|---|---|---|
| 5,938,959 | A | 8/1999 | Wang | |
| 5,951,905 | A * | 9/1999 | Iwai | H05B 6/6408 219/725 |
| 6,018,157 | A * | 1/2000 | Craft | H05B 6/6408 219/686 |
| 6,273,284 | B1 * | 8/2001 | Nottage | H05B 6/6408 211/195 |
| 2013/0010568 | A1 | 1/2013 | Bodum | |
| 2017/0238757 | A1 * | 8/2017 | Hengel | A47J 36/027 |

FOREIGN PATENT DOCUMENTS

| | | | |
|---|---|---|---|
| CN | 203016735 | U | 6/2013 |
| CN | 203088806 | U | 7/2013 |
| CN | 103284620 | A | 9/2013 |

OTHER PUBLICATIONS

Midea, Office-Action, CN201710386415.0, dated Jul. 23, 2018, 4 pgs. (No English Translation Available).

* cited by examiner

COOKING APPLIANCE

PRIORITY CLAIM AND RELATED APPLICATION

This application claims priority to Chinese Patent Application No. 201710386415.0, filed with the State Intellectual Property Office of the People's Republic of China on May 26, 2017, which is incorporated herein by reference in their entirety.

FIELD OF THE INVENTION

The present disclosure relates to the field of kitchen utensils, and in particular relates to a cooking appliance.

BACKGROUND

When a quick barbecue device is used, a lower heating plate and a magnetron are arranged below a cooking cavity and immobilized, the position of an upper heating plate can be adjusted according to the height of food so that the heating plate is in contact with the food or kept a short distance from the food, and an upper heating plate adjusting device in the prior art is locked at different positions via a positioning pin to adjust the distance between the heating plate and the food. However, in the prior art, the height of the heating plate can only be set at several fixed positions, and the position of the upper heating plate cannot be continuously set, so that the requirement for accurately positioning the heating distance of food having different heights cannot be met. Furthermore, in the existing structure, when the height of the heating plate is adjusted, the positioning pin needs to be unscrewed by means of a tool and then mounted into another positioning hole, so that the operation is complex and long time is needed. Besides, by adopting the existing adjusting device, after the height of the heating plate is adjusted, a user cannot know the food accommodating height of the cooking cavity, so that the user cannot accurately adjust the height mounting position of the upper heating plate according to the height of the food, and the user experience is poor.

Therefore, the problem to be solved at present is how to provide a cooking appliance such as a quick barbecue device which can allow the height of an upper heating plate to be adjusted simply, quickly and continuously and display the food accommodating height of a cooking cavity.

SUMMARY

The present disclosure is aimed at solving one of the technical problems in the prior art or in relevant technologies.

Thus, one purpose of the present disclosure is to provide a cooking appliance.

To achieve the above purpose, an embodiment in a first aspect of the present disclosure provides a cooking appliance, including: a cooking cavity body, in which a cooking cavity is formed; a heating plate, movably mounted in the cooking cavity; and an adjusting device, mounted to the heating plate and used for driving the heating plate to continuously reciprocate in the cooking cavity.

The cooking appliance provided by the embodiment in the first aspect of the present disclosure includes a cooking cavity body, a heating plate and an adjusting device, wherein the heating plate is used for heating food and movably mounted in the cooking cavity, thus, the heating plate can continuously reciprocate up and down or left and right in the cooking cavity under the action of the adjusting device, and when the cooking appliance is specifically used for heating food, the height of the heating plate can be adjusted according to the category and height of the food to adjust the distance between the heating plate and the bottom wall of the cooking cavity, i.e., to adjust the height, capable of accommodating food, of the accommodating cavity, so that the cooking appliance can be applied to heating and cooking of food having multiple heights. The heating plate continuously reciprocates in the cooking cavity, the height of the heating plate can thus be continuously adjusted, and with this configuration, the heating plate can be adjusted to any height, as compared with the solution of adjusting the height of the heating plate section by section or point by point, so that the heating distance of food having different heights can be accurately positioned, the mouthfeel of the heated food can be improved to improve the user experience, and the food treatment ways can also be expanded, specifically, for example, the surface of food can be pressed into various shapes (i.e., embossed) by using the heating plate, or food is compacted and heated by using the heating plate, etc., while the solution that the height of the heating plate can only be set at several fixed positions in the prior art cannot realize embossing, compaction, heating and other similar treatment on food.

Besides, the cooking appliance provided by the above embodiment of the present disclosure further has the following additional technical features:

In the above technical solution, preferably, the cooking cavity body is provided with a through hole, and the adjusting device includes a fixed part and a moving part, wherein the fixed part is mounted on the outer wall of the cooking cavity body; the moving part is movably mounted on the fixed part, the first end of the moving part is inserted into the cooking cavity via the through hole and mounted to the heating plate, and the moving part can drive the heating plate to continuously reciprocate in the cooking cavity when moving relative to the fixed part.

In this technical solution, a fixed part can be arranged outside the cooking cavity body, then a moving part capable of sliding or sliding and rotating relative to the fixed part is arranged, and furthermore, the first end, e.g., the lower end, of the moving part extends into the cooking cavity via the through hole to be fixedly connected to the heating plate. Thus, when the moving part moves up and down relative to the fixed part, the heating plate can be driven to move up and down in the cooking cavity, then the mounting height of the heating plate can be adjusted as required, and after the mounting height of the heating plate is adjusted, the moving part can be locked on the fixed part by using a self-locking device between the fixed part and the movable part or by means of an additional locking device.

Preferably, the moving part can form self-locking with the fixed part after moving relative to the fixed part.

Preferably, the adjusting device further includes a locking part, which can cooperate with the fixed part and the moving part to lock the moving part after the moving part moves.

In any above technical solution, preferably, the fixed part is a fixed sleeve mounted on the outer wall of the cooking cavity body, the moving part is a moving shaft, and the fixed sleeve is sleeved on the moving shaft; and internal threads are formed on the inner wall of the fixed sleeve, external threads matched with the internal threads are formed on the moving shaft, and the fixed sleeve is sleeved on the moving shaft via cooperation of the internal threads and the external threads.

In these technical solutions, a fixed sleeve can be arranged on the outer wall of the cooking cavity body, a moving shaft is mounted on the fixed sleeve, furthermore, internal threads are formed on the inner wall of the fixed sleeve, external threads are formed on the moving shaft, and with this configuration, the fixed sleeve is can be brought into threaded connection with the moving shaft via cooperation of the internal threads and the external threads, so that on the one hand, axial, continuous and reciprocating movement of the moving shaft relative to the fixed sleeve can be simply and quickly realized, and the heating plate can be simply and quickly driven to continuously reciprocate in the cooking cavity; and on the other hand, as the thread structure has good self-locking property, the moving shaft moving randomly relative to the fixed sleeve can form self-locking with the fixed sleeve, and an additional structure such as a locking part is not needed, so that the structure of the product can be simplified and the cost of the product can be reduced. Furthermore, the movement precision of the threaded connection structure is higher than that of other structure during driving, so that the heating distance of food having different heights can be accurately positioned; and the self-locking capability of the threaded connection structure is also very good during locking, so that the moving shaft and the fixed sleeve can be firmly locked and the heating plate can be prevented from shaking during heating. Besides, by adopting such a structure, when the height position of the heating plate is adjusted, it only needs to rotate the moving shaft without redundant additional operation; and after the height position of the heating plate is adjusted, the internal and external threads can form self-locking, so any additional operation is also not needed, the operation of a user can be simplified and the operation speed can be improved to improve the user experience.

Moreover, in another technical solution, the fixed part and the moving part may also of a structure like an injector or a structure like a piston and a cylinder, and can be locked by the locking device after the moving part moves.

In any above technical solution, preferably, the second end of the moving shaft extends out of the fixed sleeve, and the cooking appliance further includes a hand wheel and a handle, wherein the hand wheel is mounted at an end portion of the second end of the moving shaft; the handle is mounted at the edge of the hand wheel, and the moving shaft can be driven to rotate relative to the fixed sleeve by pushing the handle.

In these technical solutions, the hand wheel can be pushed by the handle to drive the moving shaft to rotate, then the height of the heating plate is adjusted, and in this way, only the handle needs to be pushed, so that the operation is convenient; and after the height position of the heating plate is adjusted, any additional operation is not needed, so that the operation of the user can be simplified and the operation speed can be improved to improve the user experience.

In any above technical solution, preferably, the handle is mounted on the hand wheel in a foldable manner; or the handle is mounted on an end face of an end of the hand wheel away from the moving shaft in a foldable manner.

In these technical solutions, the handle can be mounted on the hand wheel in a foldable manner by using a pin roll, and when it does not need to use the handle, the handle can be folded so as to fit the handle to the hand wheel, so that the area occupied by the handle can be reduced and the product can be better stored and transported.

In any above technical solution, preferably, the cooking appliance further includes an outer cover, a mounting box, a tape and a telescopic sleeve, wherein the outer cover covers the fixed sleeve, and the second end of the moving shaft extends out of the outer cover; the mounting box is mounted on the outer wall of the outer cover and sleeved on the moving shaft; the tape is mounted in the mounting box and coiled into a ring shape in the mounting box; the telescopic sleeve is sleeved on the part of the moving shaft extending out of the outer cover, one end of the telescopic sleeve is connected to the moving shaft or connected to an end portion of the end of the moving shaft extending out of the outer cover, the other end of the telescopic sleeve is connected to the start end of the tape, and when the moving shaft rotates, the tape can be driven by the telescopic sleeve to be uncoiled or retracted according to the moving distance of the moving shaft; wherein the mounting box is provided with a display window on the wall, the display window is used for displaying scales on the tape which indicate the accommodating cavity's height capable of accommodating food or an article (i.e., the distance between the heating plate and the bottom wall of the accommodating cavity).

In these technical solutions, an outer cover can be arranged outside the cooking cavity, so that the fixed sleeve can be concealed inside the outer cover, and the mounting box and other like structure can be mounted on the outer cover. The mounting box is used for mounting the tape and displaying the scales on the tape, wherein the telescopic sleeve is mounted on the mounting box and sleeved on the moving shaft and can be driven by the moving shaft to rotate, and the other end of the telescopic sleeve is further connected to the start end of the tape, so that driven by the moving shaft, the telescopic sleeve can uncoil the coiled tape turn by turn or retract the turns of the tape successively; specifically, the tape is uncoiled when the moving shaft rotates forward, and is retracted when the moving shaft rotate reversely; the scale of the tape at the corresponding position of the display window is changed due to uncoiling or retraction of the tape, the moving distance of the moving shaft can be read according to the scale of the tape, furthermore, the initial distance L between the heating plate and the bottom wall of the cooking cavity can be measured in advance, then the scale displayed by the display window is adjusted to the value of the initial distance L in advance, thereafter, the tape can be uncoiled or retracted the length equal to the distance the moving shaft moves, the current distance L1 between the heating plate and the bottom wall of the cooking cavity can be accurately displayed, i.e., the distance L1 can be directly read from the display window, and the user can directly read the current distance L1 between the heating plate and the bottom wall of the cooking cavity without conversion with this configuration, so that the current distance L1 between the heating plate and the bottom wall of the cooking cavity can be simply and intuitively displayed, the current distance L1 between the heating plate and the bottom wall of the cooking cavity is visualized, and the user experience can thus be improved.

In the case a cover such as a housing is arranged outside the cooking cavity body, the above outer cover can be omitted, that is, the outer cover can be enlarged to cover the whole cooking cavity body or cover half of the cooking cavity body.

Specifically, when the moving shaft rotates one circle, the axial moving distance of the moving shaft is equal to a pitch of the moving shaft, scales can be marked on the tape according to the corresponding relation between the pitch of the moving shaft and the change length of the tape when the moving shaft rotates one circle, for example, when the pitch of the moving shaft is 5 mm, the perimeter of one circle the tape rotates can be divided into five sections, and then corresponding values are marked, so that the moving height of the moving shaft is consistent with the change length of the tape.

Specifically, the cooking appliance further includes a tape shell, which is mounted in the mounting box, and the tape is coiled inside the tape shell.

Specifically, the tape includes a measuring tape and a flexible tape.

Specifically, the cooking appliance further includes a transparent plate mounted on the display window to isolate the mounting box from the outside, so as to prevent external dust from entering the mounting box.

The uncoiled tape is newly coiled around a center, and preferably, the tape is tensioned all the time.

Preferably, the telescopic sleeve is connected to an end portion of the end of the moving shaft extending out of the outer cover, with this configuration, the telescopic sleeve can enclose the exposed part of the moving shaft, and thus the moving shaft can be protected from being polluted by the outside, to ensure the drive precision and hand feel of the moving shaft are kept.

In any above technical solution, the cooking appliance further includes a pointer, which is arranged on the mounting box and nearby the display window.

In these technical solutions, the specific scale value displayed by the display window can be read by indication of the pointer, so that the user can clearly and quickly read the scale value displayed by the display window.

In any above technical solution, preferably, the cooking appliance further includes a mounting plate sleeved on the first end of the moving part and provided with a mounting hole, wherein the cooking cavity body is provided with a threaded hole, and one end of a connector can penetrate through the mounting hole and then be inserted into the threaded hole to assemble the mounting plate and the cooking cavity body; wherein a bearing plate is arranged at an end portion of the first end of the moving part, a side wall of the bearing plate is provided with an annular mounting groove, the mounting plate is sleeved on the annular mounting groove of the bearing plate, and the bearing plate is rotatable relative to the mounting plate.

In these technical solutions, the mounting plate is mounted on the cooking cavity body via bolts or screws, and furthermore, the mounting plate is rotatably sleeved in the annular mounting groove of the bearing plate, i.e., the mounting plate can be clamped by the bearing plate, so that slidable installation between the bearing plate and the mounting plate can be realized by using the bearing plate. This mounting manner achieves a simple structure and easy installation, and can thus simplify the structure of the product and reduce the cost of the product.

In any above technical solution, preferably, the cooking cavity body includes a cooking cover body, a cooking seat body, a carrier plate and a second heating element, wherein the cooking cover body is provided with a first cooking groove; the cooking cover body covers the cooking seat body, the cooking seat body is provided with a second cooking groove, and the cooking cavity is composed of the first cooking groove and the second cooking groove; the carrier plate is mounted in the second cooking groove; the second heating element is mounted in the second cooking groove and located on a side of the carrier plate away from the cooking seat body; wherein the heating plate is mounted in the cooking cover body, and forms a preset angle which is more than or equal to 0° and less than 90° relative to a plane of the opening of the first cooking groove.

In this technical solution, the cooking cavity body includes a cooking cover body and a cooking seat body, so that the cooking cavity body can be opened and closed; the carrier plate is used for placing tableware, food, etc.; the second heating element is preferably a heating tube and is used for heating food on one side of the carrier plate, and the heating plate is used for heating food on the other side of the carrier plate, so that the food can be simultaneously heated on the two sides.

Specifically, the preset angle is preferably equal to 0°, i.e., the heating plate is preferably horizontally arranged, and of course, the heating plate may also be arranged obliquely in the cooking cavity.

In any above technical solution, preferably, the cooking appliance further includes a cooking cover, a cooking seat cover and a microwave generator, wherein the cooking cover covers the cooking cover body; the cooking seat cover covers the cooking seat body, and forms a first mounting cavity with the cooking seat body; and the microwave generator is mounted in the first mounting cavity.

In these technical solutions, the cooking cover body can be covered by the cooking cover, and additionally the cooking seat body can be covered by the cooking seat cover, with this configuration, the cooking cavity body can be covered to protect the cooking cavity body, and furthermore, mounting cavities can be formed by the cooking cover and the cooking cover body as well as the cooking seat cover and the cooking seat body to mount other electric parts of the product. The microwave generator is used for generating microwaves, thereby improving the heating efficiency of food.

The cooking cover covers the cooking cover body and forms a second mounting cavity with the cooking cover body, the fixed sleeve is mounted in the second mounting cavity, and the outer cover and the cooking cover form an integrated structure, which is equivalent to that the fixed sleeve is directly mounted in the cooking cover, and the outer cover is omitted.

In any above technical solution, preferably, the cooking appliance further includes supporting legs, which are mounted on the outer wall of the cooking cavity body and used for supporting the cooking appliance; wherein the supporting legs are provided with scales.

In these technical solutions, when the cover, e.g., the cooking seat cover, is arranged on the cooking cavity body, the supporting legs can be indirectly mounted on the outer wall of the cooking cavity body via the cover, and of course, when no cover is arranged on the cooking cavity body, the supporting legs can be directly mounted on the outer wall of the cooking cavity body, wherein the supporting legs are used for supporting the whole product, and may also be used for measuring the height of food, so that the mounting height of the heating plate can be reasonably adjusted according to the height of food, so that the height of the cooking cavity capable of accommodating food can be adapted to the height of the food itself.

In any above technical solution, preferably, the cooking appliance is a quick barbecue device or an oven or a microwave oven. Of course, the cooking appliance may also be of other structure besides the quick barbecue device or oven or microwave oven.

The additional aspects and advantages of the present disclosure will become obvious in the following description or be learnt from practice of the present disclosure.

BRIEF DESCRIPTION OF THE DRAWINGS

The above-mentioned and/or additional aspects and advantages of the present disclosure will become obvious and be easily understood from the description of the embodiments in conjunction with the following accompanying drawings, in which.

Figure 1:
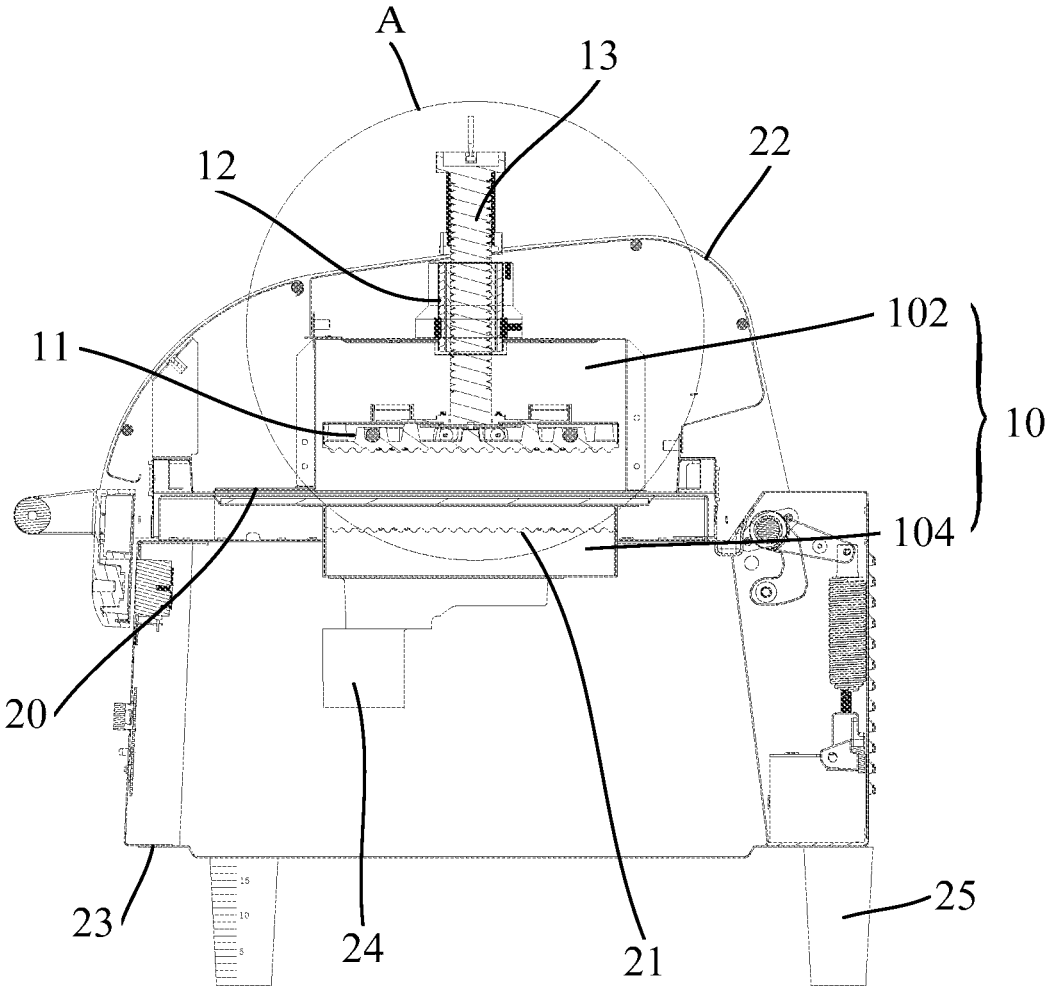
FIG. 1 is a structural schematic diagram of a cooking appliance described in one embodiment of the prevent invention.

In the drawings, the corresponding relations between reference signs and part names in FIGS. 1 to 6 are as follows: cooking cavity body: 10, cooking cover body: 102, cooking seat body: 104, heating plate: 11, fixed sleeve: 12, moving shaft: 13, bearing plate: 132, mounting plate: 14, hand wheel: 15, handle: 16, mounting box: 17, pointer: 172, tape: 18, telescopic sleeve: 19, carrier plate: 20, second heating element: 21, cooking cover: 22, cooking seat cover: 23, microwave generator: 24, supporting leg: 25.

DETAILED DESCRIPTION OF THE EMBODIMENTS

In order to understand the above purposes, features and advantages of the present disclosure more clearly, the present disclosure will be further described in detail below in combination with the accompanying drawings and specific embodiments. It should be noted that the embodiments of the present application and the features in the embodiments may be combined with each other without conflicts.

Elaborated in the following description are many specific details for sufficiently understanding the present disclosure. However, the present disclosure may also be implemented in other ways different from those described herein, so the protection scope of the present disclosure is not limited by the following disclosed specific embodiments.

A cooking appliance according to some embodiments of the present disclosure will be described below with references to FIGS. 1-6.

As shown in FIGS. 1-6, an embodiment in the first aspect of the present disclosure provides a cooking appliance, including: a cooking cavity body 10, in which a cooking cavity is formed; a heating plate 11, movably mounted in the cooking cavity; and an adjusting device, mounted to the heating plate 11 and used for driving the heating plate 11 to continuously reciprocate in the cooking cavity.

The cooking appliance provided by the embodiment of the first aspect of the present disclosure includes a cooking cavity body 10, a heating plate 11 and an adjusting device, wherein the heating plate 11 is used for heating food and is movably mounted in the cooking cavity, thus, the heating plate 11 can continuously reciprocate up and down or left and right in the cooking cavity under the action of the adjusting device, and when the cooking appliance is specifically used for heating food, the height of the heating plate 11 can be adjusted according to the category and height of the food to adjust the distance between the heating plate 11 and the bottom wall of the cooking cavity, i.e., to adjust the height, capable of accommodating food, of the accommodating cavity, so that the cooking appliance can be applied to heating and cooking of food having multiple heights. The heating plate 11 continuously reciprocates in the cooking cavity, the height of the heating plate 11 can thus be continuously adjusted, and with this configuration, the heating plate 11 can be adjusted to any height as compared with the solution of adjusting the height of the heating plate 11 section by section or point by point, so that the heating distance of food having different heights can be accurately positioned, the mouthfeel of the heated food can be improved to improve the user experience, and the food treatment ways can also be expanded, specifically, for example, the surface of food can be pressed into various shapes (i.e., embossed) by using the heating plate 11, or food is compacted and heated by using the heating plate 11, etc., while the solution that the height of the heating plate 11 can only be set at several fixed positions in the prior art cannot realize embossing, compaction heating and other similar treatment on food.

Figure 2:
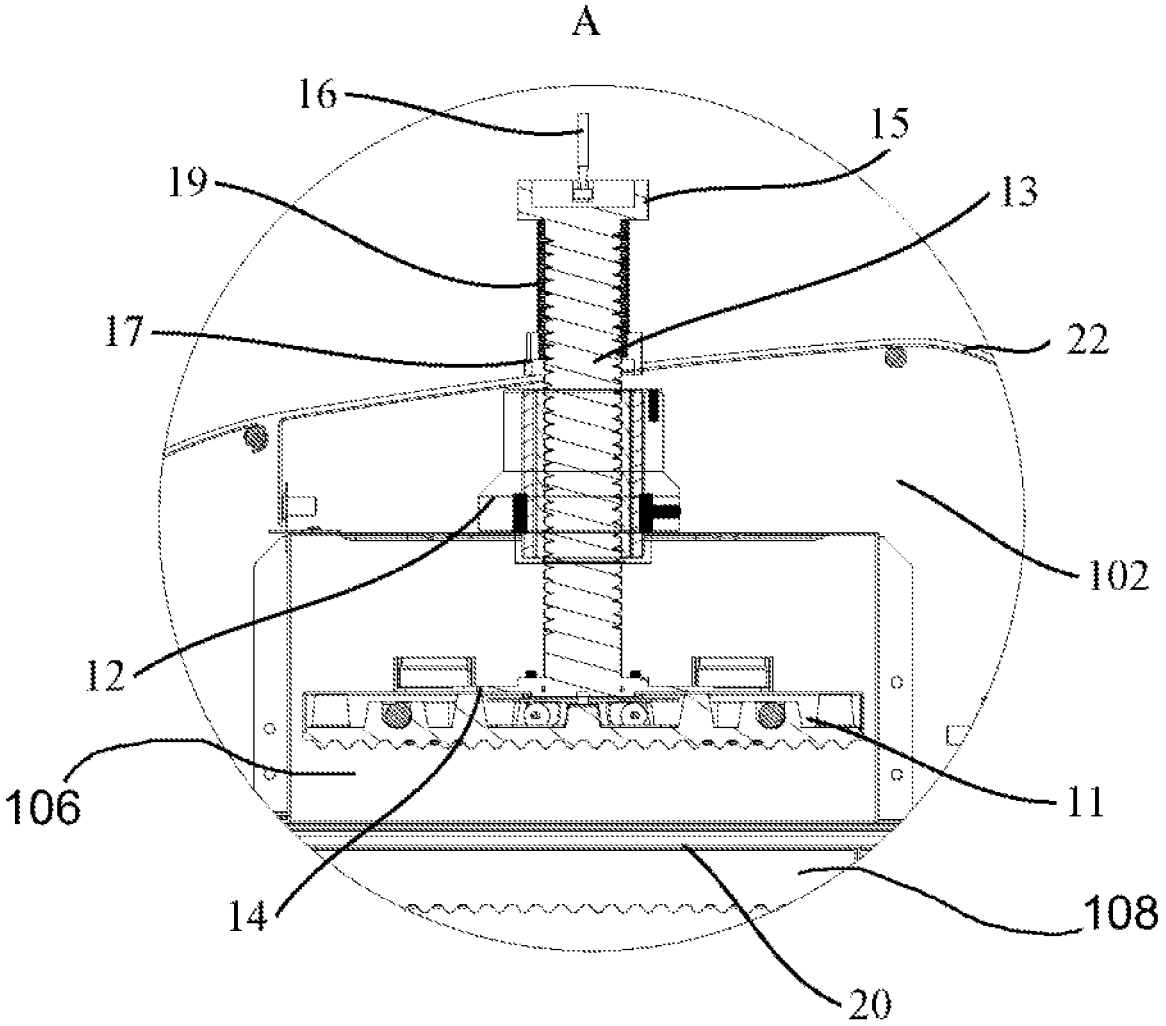
FIG. 2 is a partial enlarged schematic diagram of part A of the cooking appliance shown in FIG. 1.
Figure 3:
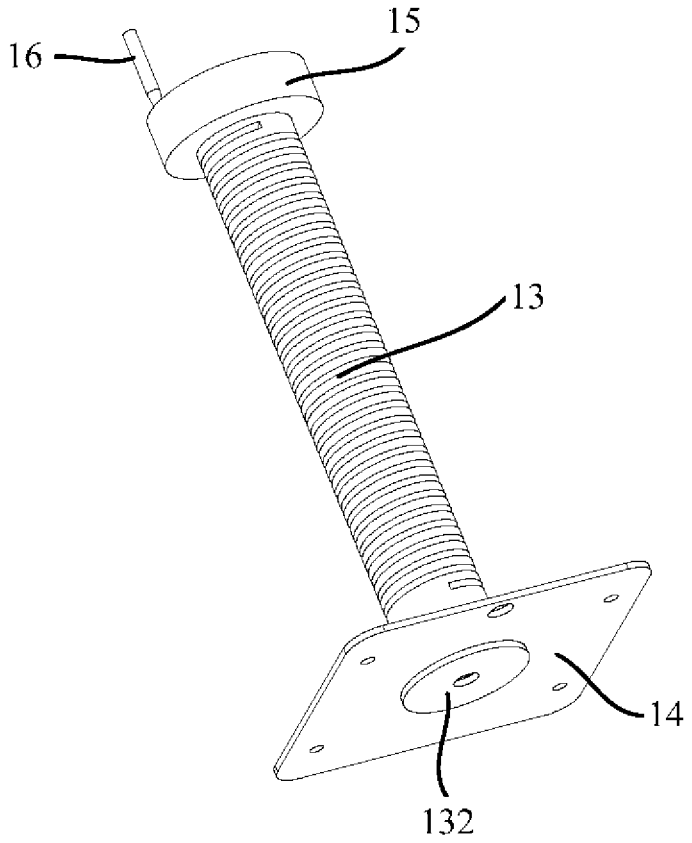
FIG. 3 is a partial structural schematic diagram of the cooking appliance described in one embodiment of the prevent invention.

In the above embodiment, preferably, as shown in FIGS. 1 and 2, the cooking cavity body 10 is provided with a through hole, and the adjusting device includes a fixed part and a moving part, wherein the fixed part is mounted on the outer wall of the cooking cavity body 10; the moving part is movably mounted on the fixed part, the first end of the moving part is inserted into the cooking cavity via the through hole and mounted to the heating plate 11, and the moving part can drive the heating plate 11 to continuously reciprocate in the cooking cavity when moving relative to the fixed part.

In this embodiment, a fixed part can be arranged outside the cooking cavity body 10, then a moving part capable of sliding or sliding and rotating relative to the fixed part is arranged, and additionally, the first end, e.g., the lower end, of the moving part extends into the cooking cavity via the through hole to be fixedly connected to the heating plate 11. Thus, when the moving part moves up and down relative to the fixed part, the heating plate 11 can be driven to move up and down in the cooking cavity, then the mounting height of the heating plate 11 can be adjusted as required, and after the mounting height of the heating plate 11 is adjusted, the moving part can be locked on the fixed part by using a self-locking device between the fixed part and the movable part or by means of an additional locking device.

Preferably, the moving part can form self-locking with the fixed part after moving relative to the fixed part.

Preferably, the adjusting device further includes a locking part, which can cooperate with the fixed part and the moving part to lock the moving part after the moving part moves.

In any above embodiment, preferably, as shown in FIG. 1 and FIGS. 2 to 4, the fixed part is a fixed sleeve 12 mounted on the outer wall of the cooking cavity body 10, the moving part is a moving shaft 13, and the fixed sleeve 12 is sleeved on the moving shaft 13; wherein internal threads are formed on the inner wall of the fixed sleeve 12, external threads matched with the internal threads are formed on the moving shaft 13, and the fixed sleeve 12 is sleeved on the moving shaft 13 via cooperation of the internal threads and the external threads.

In these embodiments, a fixed sleeve 12 can be arranged on the outer wall of the cooking cavity body 10, a moving shaft 13 is mounted on the fixed sleeve 12, furthermore, internal threads are formed on the inner wall of the fixed sleeve 12, external threads are formed on the moving shaft 13, and with this configuration, the fixed sleeve 12 can be put into threaded connection with the moving shaft 13 via cooperation of the internal threads and the external threads, so that on the one hand, axial, continuous and reciprocating movement of the moving shaft 13 relative to the fixed sleeve 12 can be simply and quickly realized, and the heating plate 11 can be simply and quickly driven to continuously reciprocate in the cooking cavity; and on the other hand, as the thread structure has good self-locking property, the moving shaft 13 after moving randomly relative to the fixed sleeve 12 can form self-locking with the fixed sleeve 12, and an additional structure suck as a locking part is not needed, so that the structure of the product can be simplified and the cost of the product can be reduced. Furthermore, the movement precision of the threaded connection structure is higher than that of other structure during driving, so that the heating distance of food having different heights can be accurately positioned; and the self-locking capability of the threaded connection structure is also very good during locking, so that the moving shaft 13 and the fixed sleeve 12 can be firmly locked, and thus the heating plate 11 can be prevented from shaking during heating. Besides, by adopting such a structure, when the height position of the heating plate 11 is adjusted, it only needs to rotate the moving shaft 13 without redundant additional operation; and after the height position of the heating plate 11 is adjusted, the internal and external threads can form self-locking, so any additional operation is also not needed, the operation of a user can be simplified and the operation speed can be improved to improve the user experience.

In any above embodiment, preferably, as shown in FIG. 1 and FIGS. 2 to 4, the second end of the moving shaft 13 extends out of the fixed sleeve 12, and the cooking appliance further includes a hand wheel 15 and a handle 16, wherein the hand wheel 15 is mounted at an end portion of the second end of the moving shaft 13; the handle 16 is mounted at the edge of the hand wheel 15, and the moving shaft 13 can be driven to rotate relative to the fixed sleeve by pushing the handle 16.

In these embodiments, the hand wheel 15 can be pushed by the handle 16 to drive the moving shaft 13 to rotate, so that the height of the heating plate 11 is adjusted, and in this way, only the handle 16 needs to be pushed, so the operation is convenient; and after the height position of the heating plate 11 is adjusted, any additional operation is also not needed, so the operation of the user can be simplified and the operation speed can be improved to improve the user experience.

Figure 4:
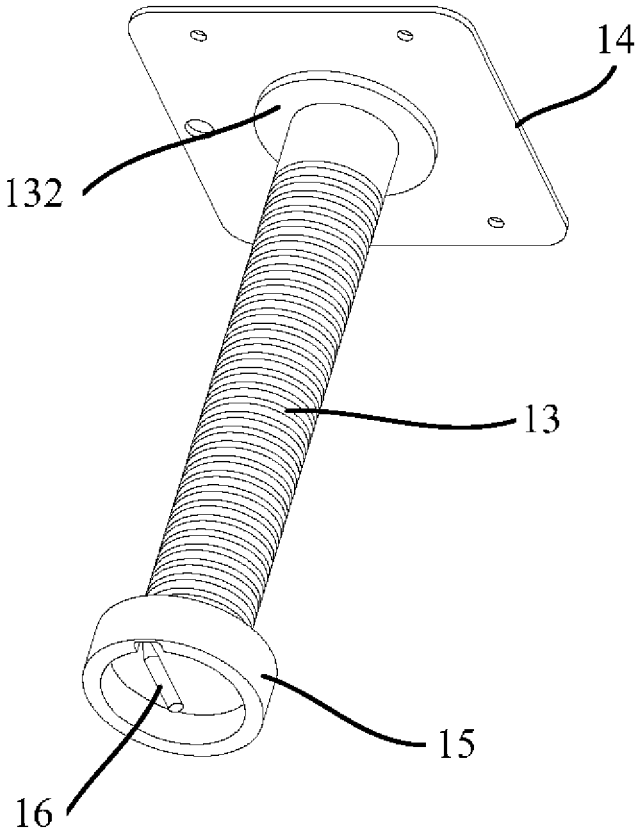
FIG. 4 is another partial structural schematic diagram of the cooking appliance described in one embodiment of the prevent invention.

In any above embodiment, preferably, as shown in FIG. 4, the handle 16 is mounted on the hand wheel 15 in a foldable manner; or the handle 16 is mounted on an end face of an end of the hand wheel 15 away from the moving shaft 13 in a foldable manner.

In these embodiments, the handle 16 can be mounted on the hand wheel 15 in a foldable manner by using a pin roll, and when the handle 16 is not used, the handle 16 can be folded so as to fit the handle to the hand wheel 15, so that the area occupied by the handle 16 can be reduced and the product can be better stored and transported.

In any above embodiment, preferably, as shown in FIGS. 1, 2, 5 and 6, the cooking appliance further includes an outer cover, a mounting box 17, a tape 18 and a telescopic sleeve 19, wherein the outer cover covers the fixed sleeve 12, and the second end of the moving shaft 13 extends out of the outer cover; the mounting box 17 is mounted on the outer wall of the outer cover and sleeved on the moving shaft 13; the tape 18 is mounted in the mounting box 17 and coiled into a ring shape in the mounting box 17; the telescopic sleeve 19 is sleeved on the part of the moving shaft 13 extending out of the outer cover, one end of the telescopic sleeve 19 is connected to the moving shaft 13 or connected to an end portion of the end of the moving shaft 13 extending out of the outer cover, the other end of the telescopic sleeve 19 is connected to the start end of the tape 18, and when the moving shaft 13 rotates, the tape 18 can be driven by the telescopic sleeve 19 to be uncoiled or retracted according to the moving distance of the moving shaft 13; wherein the mounting box 17 is provided with a display window on the wall, the display window is used for displaying scales on the tape 18 which indicate the accommodating cavity's height capable of accommodating food or an article (i.e., the distance between the heating plate 11 and the bottom wall of the accommodating cavity).

In these embodiments, an outer cover can be arranged outside the cooking cavity, so that the fixed sleeve 12 can be concealed inside the outer cover, and additionally the mounting box 17 and other like structure can be mounted on the outer cover. The mounting box 17 is used for mounting the tape 18 and displaying the scales on the tape 18, wherein the telescopic sleeve 19 is mounted on the mounting box 17 and sleeved on the moving shaft 13 and can be driven by the moving shaft 13 to rotate, and the other end of the telescopic sleeve 19 is further connected to the start end of the tape 18, so that driven by the moving shaft 13, the telescopic sleeve 19 can uncoil, the coiled tape 18 turn by turn or retract the turns of the tape successively; specifically, the tape 18 is uncoiled when the moving shaft rotates forward, and is retracted when the moving shaft rotate reversely; the scale of the tape 18 at the corresponding position of the display window is changed due to uncoiling or retraction of the tape 18, the moving distance of the moving shaft 13 can be read according to the scale of the tape 18, furthermore, the initial distance L between the heating plate 11 and the bottom wall of the cooking cavity can be measured in advance, then the scale displayed by the display window is adjusted to the value of the initial distance L in advance, thereafter, the tape 18 can be uncoiled or retracted the length equal to the distance the moving shaft 13 moves, the current distance L1 between the heating plate 11 and the bottom wall of the cooking cavity can be accurately displayed, i.e., the distance L1 can be directly read from the display window, and the user can directly read the current distance L1 between the heating plate 11 and the bottom wall of the cooking cavity without conversion with this configuration, so that the current distance L1 between the heating plate 11 and the bottom wall of the cooking cavity can be simply and intuitively displayed, the current distance L1 between the heating plate 11 and the bottom wall of the cooking cavity is visualized, and the user experience can thus be improved.

When a cover such as a housing is arranged outside the cooking cavity body 10, the above outer cover can be omitted, that is, the outer cover can be enlarged to cover the whole cooking cavity body 10 or cover half of the cooking cavity body 10.

Specifically, when the moving shaft 13 rotates one circle, the axial moving distance of the moving shaft 13 is equal to a pitch of the moving shaft 13, scales can be marked on the tape 18 according to the corresponding relation between the pitch of the moving shaft 13 and the change length of the tape 18 when the moving shaft 13 rotates one circle, for example, when the pitch of the moving shaft 13 is 5 mm, the perimeter of one circle the tape 18 rotates can be divided into five sections, and then corresponding values are marked, so that the moving height of the moving shaft 13 is consistent with the change length of the tape 18.

Specifically, the cooking appliance further includes a tape shell, the tape shell is mounted in the mounting box 17, and the tape 18 is coiled inside the tape 18 shell.

Specifically, the cooking appliance further includes a transparent plate mounted on the display window to isolate the mounting box 17 from the outside, so as to prevent external dust from entering the mounting box 17.

The uncoiled tape 18 is newly coiled around a center, and preferably, the tape 18 is tensioned all the time.

Preferably, the telescopic sleeve 19 is connected to the end of the moving shaft 13 extending out of the outer cover, with this configuration, the telescopic sleeve 19 can enclose the exposed part of the moving shaft 13, and thus the moving shaft 13 can be protected from being polluted by the outside, to ensure the drive precision and handfeel of the moving shaft 13.

Figure 5:
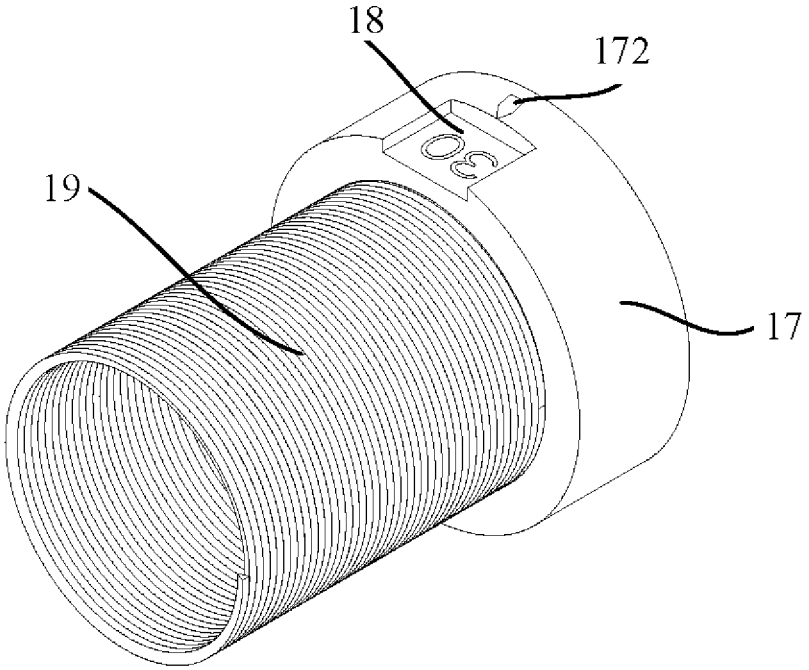
FIG. 5 is a further partial structural schematic diagram of the cooking appliance described in one embodiment of the prevent invention.
Figure 6:
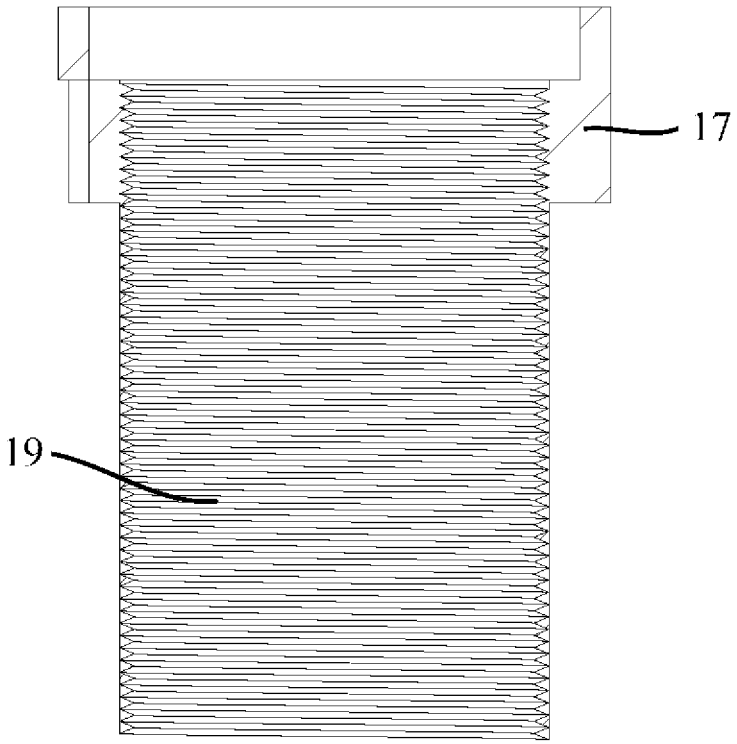
FIG. 6 is a further partial structural schematic diagram of the cooking appliance described in one embodiment of the prevent invention.

In any above embodiment, as shown in FIGS. 5 and 6, the cooking appliance further includes a pointer 172, which is arranged on the mounting box 17 and nearby the display window.

In these embodiments, the specific scale value displayed by the display window can be read by indication of the pointer 172, so that the user can clearly and quickly read the scale value displayed by the display window.

In any above embodiment, preferably, as shown in FIGS. 1-4, the cooking appliance further includes a mounting plate 14 sleeved on the first end of the moving part and provided with a mounting hole, wherein the cooking cavity body 10 is provided with a threaded hole, and one end of a connector can penetrate through the mounting hole and then be inserted into the threaded hole to assemble the mounting plate 14 and the cooking cavity body 10; wherein a bearing plate 132 is arranged at an end portion of the first end of the moving part, a side wall of the bearing plate 132 is provided with an annular mounting groove, the mounting plate 14 is sleeved on the annular mounting groove of the bearing plate 132, and the bearing plate 132 is rotatable relative to the mounting plate 14.

In these embodiments, the mounting plate 14 is mounted on the cooking cavity body 10 via bolts or screws, and furthermore, the mounting plate 14 is rotatably sleeved in the annular mounting groove of the bearing plate 132, i.e., the mounting plate 14 can be clamped by the bearing plate 132, so that slidable installation between the bearing plate 132 and the mounting plate 14 can be realized by using the bearing plate 132. This mounting manner achieves a simple structure and easy installation, and thus can simplify the structure of the product and reduce the cost of the product.

In any above embodiment, preferably, as shown in FIGS. 1 and 2, the cooking cavity body 10 includes a cooking cover body 102, a cooking seat body 104, a carrier plate 20 and a second heating element 21, wherein the cooking cover body 102 is provided with a first cooking groove 106; the cooking cover body 102 covers the cooking seat body 104, the cooking seat body 104 is provided with a second cooking groove 108, and the cooking cavity is composed of the first cooking groove 106 and the second cooking groove 108; the carrier plate 20 is mounted in the second cooking groove 108; the second heating element 21 is mounted in the second cooking groove 108 and located on a side of the carrier plate 20 away from the cooking seat body 104; wherein the heating plate 11 is mounted in the cooking cover body 102, and forms a preset angle which is more than or equal to 0° and less than 90° relative to a plane of the opening of the first cooking groove 106.

In this embodiment, the cooking cavity body 10 includes a cooking cover body 102 and a cooking seat body 104, so that the cooking cavity body 10 can be opened and closed; the carrier plate 20 is used for putting tableware, food, etc.; the second heating element 21 is preferably a heating tube and is used for heating food on one side of the carrier plate 20, and the heating plate 11 is used for heating food on the other side of the carrier plate 20, so that the food can be simultaneously heated on two sides.

Specifically, as shown in FIGS. 1 and 2, the preset angle is preferably equal to 0°, i.e., the heating plate 11 is preferably horizontally arranged, and of course, the heating plate 11 may also be arranged obliquely in the cooking cavity.

In any above embodiment, preferably, as shown in FIG. 1, the cooking appliance further includes a cooking cover 22, a cooking seat cover 23 and a microwave generator 24, wherein the cooking cover 22 covers the cooking cover body 102; the cooking seat cover 23 covers the cooking seat body 104, and forms a first mounting cavity with the cooking seat body 104; and the microwave generator 24 is mounted in the first mounting cavity.

In these embodiments, the cooking cover body 102 can be covered by the cooking cover 22, and the cooking seat body 104 can be covered by the cooking seat cover 23, with this configuration, the cooking cavity body 10 can be covered to protect the cooking cavity body 10, and furthermore, mounting cavities can be formed by the cooking cover 22 and the cooking cover body 102 as well as the cooking seat cover 23 and the cooking seat body 104 to mount other electric parts of the product. The microwave generator 24 is used for generating microwaves, thereby improving the heating efficiency of food.

The cooking cover 22 covers the cooking cover body 102 and forms a second mounting cavity with the cooking cover body 102, the fixed sleeve 12 is mounted in the second mounting cavity, and the outer cover and the cooking cover 22 form an integrated structure, which is equivalent to that the fixed sleeve 12 is directly mounted in the cooking cover, and the outer cover is omitted.

In any above embodiment, preferably, as shown in FIG. 1, the cooking appliance further includes supporting legs 25, which are mounted on the outer wall of the cooking cavity body 10 and used for supporting the cooking appliance; wherein the supporting legs 25 are provided with scales.

In these embodiments, when the cover, e.g., the cooking seat cover 23, is arranged on the cooking cavity body 10, the supporting legs 25 can be indirectly mounted on the outer wall of the cooking cavity body 10 via the cover, of course, when no cover is arranged on the cooking cavity body 10, the supporting legs 25 may also be directly mounted on the outer wall of the cooking cavity body 10, wherein the supporting legs 25 are used for supporting the whole product on the one hand and measuring the height of food on the other hand, and thus the mounting height of the heating plate 11 can be reasonably adjusted according to the height of food, so that the height of the cooking cavity capable of accommodating food can be adapted to the height of the food itself.

In any above embodiment, preferably, the cooking appliance is a quick barbecue device or an oven or a microwave oven. Of course, the cooking appliance may also be of other structure besides the quick barbecue device or oven or microwave oven.

In the description of the specification, the terms "connected", "mounted", "fixed" and the like should be understood in a broad sense, for example, the term "connected" may be fixedly connected, detachably connected, integrally connected, directly connected, or indirectly connected via a medium. Those of ordinary skill in the art could understand the specific meanings of said terms in the present disclosure according to specific conditions.

In the description of the specification, the terms "one embodiment", "some embodiments", "specific embodiment" and the like are used to indicate that the specific feature, structure, material or characteristic described in conjunction with the embodiment or example is included in at least one embodiment or example of the present disclosure. In the specification, the schematic expressions of said terms do not necessarily indicate the same embodiment or example. Besides, the described specific feature, structure, material or characteristic may be combined in any one or more embodiments or examples in an appropriate mode.

Described above are merely preferred embodiments of the present disclosure, which are not used for limiting the present disclosure. Various modifications and changes may be made to the present disclosure for those skilled in the art. Any modification, equivalent substitution, improvement and the like made within the spirit and principle of the present disclosure shall be encompassed within the protection scope of the present disclosure.

What is claimed is:

1. A cooking appliance, comprising:

a cooking cavity body, in which a cooking cavity is formed;

a heating plate, movably mounted in the cooking cavity; and an adjusting device, mounted to the heating plate and used for driving the heating plate to continuously reciprocate in the cooking cavity, wherein the cooking cavity body is provided with a through hole, and the adjusting device comprises:

a fixed part, mounted on an outer wall of the cooking cavity body; and a moving part, movably mounted on the fixed part, wherein a first end of the moving part is inserted into the cooking cavity via the through hole and mounted to the heating plate, and the moving part is capable of driving the heating plate to continuously reciprocate in the cooking cavity when moving relative to the fixed part, the fixed part is a fixed sleeve mounted on the outer wall of the cooking cavity body, the moving part is a moving shaft, and the fixed sleeve is sleeved on the moving shaft; and wherein internal threads are formed on the inner wall of the fixed sleeve, external threads matched with the internal threads are formed on the moving shaft, and the fixed sleeve is sleeved on the moving shaft via cooperation of the internal threads and the external threads.

2. The cooking appliance of claim 1, wherein the second end of the moving shaft extends out of the fixed sleeve, and the cooking appliance further comprises:

a hand wheel, mounted at an end portion of the second end of the moving shaft; and a handle, mounted at the edge of the hand wheel, wherein the moving shaft can be driven to rotate relative to the fixed sleeve by pushing the handle.

3. The cooking appliance of claim 2, wherein the handle is mounted on the hand wheel in a foldable manner; or the handle is mounted on an end face of an end of the hand wheel away from the moving shaft in a foldable manner.

4. The cooking appliance of claim 1, further comprising:

an outer cover, covering the fixed sleeve, wherein the second end of the moving shaft extends out of the outer cover;

a mounting box, mounted on the outer wall of the outer cover and sleeved on the moving shaft;

a tape, mounted in the mounting box and coiled into a ring shape in the mounting box; and a telescopic sleeve, sleeved on the part of the moving shaft extending out of the outer cover, wherein one end of the telescopic sleeve is connected to the moving shaft or connected to an end portion of the end of the moving shaft extending out of the outer cover, the other end of the telescopic sleeve is connected to the start end of the tape, and when the moving shaft rotates, the tape can be driven by the telescopic sleeve to be uncoiled or retracted according to a moving distance of the moving shaft;

wherein the mounting box is provided with a display window on the wall, the display window is used for displaying scales on the tape which indicate an accommodating cavity's height capable of accommodating food or an article.

5. The cooking appliance of claim 4, further comprising:

a pointer, arranged on the mounting box and nearby the display window.

6. The cooking appliance of claim 1, further comprising:

a mounting plate, sleeved on the first end of the moving part and provided with a mounting hole, wherein the cooking cavity body is provided with a threaded hole, and one end of a connector can penetrate through the mounting hole and then be inserted into the threaded hole to assemble the mounting plate and the cooking cavity body;

wherein a bearing plate is arranged at an end portion of the first end of the moving part, a side wall of the bearing plate is provided with an annular mounting groove, the mounting plate is sleeved on the annular mounting groove of the bearing plate, and the bearing plate is rotatable relative to the mounting plate.

7. The cooking appliance of claim 1, wherein the cooking cavity body comprises:

a cooking cover body, provided with a first cooking groove;

a cooking seat body, covered by the cooking cover body and provided with a second cooking groove, wherein the cooking cavity is composed of the first cooking groove and the second cooking groove;

a carrier plate, mounted in the second cooking groove; and a second heating element, mounted in the second cooking groove and located on a side of the carrier plate away from the cooking seat body;

wherein the heating plate is mounted in the cooking cover body, and forms a preset angle which is more than or equal to 0° and less than 90° relative to a plane of the opening of the first cooking groove.

8. The cooking appliance of claim 2, wherein the cooking cavity body comprises:

a cooking cover body, provided with a first cooking groove;

a cooking seat body, covered by the cooking cover body and provided with a second cooking groove, wherein the cooking cavity is composed of the first cooking groove and the second cooking groove;

a carrier plate, mounted in the second cooking groove; and a second heating element, mounted in the second cooking groove and located on a side of the carrier plate away from the cooking seat body;

wherein the heating plate is mounted in the cooking cover body, and forms a preset angle which is more than or equal to 0° and less than 90° relative to a plane of the opening of the first cooking groove.

9. The cooking appliance of claim 3, wherein the cooking cavity body comprises:

a cooking cover body, provided with a first cooking groove;

a cooking seat body, covered by the cooking cover body and provided with a second cooking groove, wherein the cooking cavity is composed of the first cooking groove and the second cooking groove;

a carrier plate, mounted in the second cooking groove; and a second heating element, mounted in the second cooking groove and located on a side of the carrier plate away from the cooking seat body;

wherein the heating plate is mounted in the cooking cover body, and forms a preset angle which is more than or equal to 0° and less than 90° relative to a plane of the opening of the first cooking groove.

10. The cooking appliance of claim 7, further comprising:

a cooking cover, covering the cooking cover body;

a cooking seat cover, covering the cooking seat body, and forming a first mounting cavity with the cooking seat body; and a microwave generator, mounted in the first mounting cavity.

11. The cooking appliance of claim 8, further comprising:

a cooking cover, covering the cooking cover body;

a cooking seat cover, covering the cooking seat body, and forming a first mounting cavity with the cooking seat body; and a microwave generator, mounted in the first mounting cavity.

12. The cooking appliance of claim 9, further comprising:

a cooking cover, covering the cooking cover body;

a cooking seat cover, covering the cooking seat body, and forming a first mounting cavity with the cooking seat body; and a microwave generator, mounted in the first mounting cavity.

13. The cooking appliance of claim 1, further comprising:

supporting legs, mounted on the outer wall of the cooking cavity body and used for supporting the cooking appliance, wherein the supporting legs are provided with scales.

14. The cooking appliance of claim 1, wherein the cooking appliance is a quick barbecue device or an oven or a microwave oven.

15. A cooking appliance, comprising:

a cooking cavity body, in which a cooking cavity is formed;

a heating plate, movably mounted in the cooking cavity; and an adjusting device, mounted to the heating plate and used for driving the heating plate to continuously reciprocate in the cooking cavity, wherein the cooking cavity body comprises:

a cooking cover body, provided with a first cooking groove;

a cooking seat body, covered by the cooking cover body and provided with a second cooking groove, wherein the cooking cavity is composed of the first cooking groove and the second cooking groove;

a carrier plate, mounted in the second cooking groove; and a second heating element, mounted in the second cooking groove and located on a side of the carrier plate away from the cooking seat body;

wherein the heating plate is mounted in the cooking cover body, and forms a preset angle which is more than or equal to 0° and less than 90° relative to a plane of the opening of the first cooking groove.

16. The cooking appliance of claim 15, further comprising:

a cooking cover, covering the cooking cover body;

a cooking seat cover, covering the cooking seat body, and forming a first mounting cavity with the cooking seat body; and a microwave generator, mounted in the first mounting cavity.

* * * * *